US005331313A

United States Patent [19]

Koning

[11] Patent Number: 5,331,313

[45] Date of Patent: Jul. 19, 1994

[54] MARKER ASSEMBLY FOR USE WITH AN ELECTRONIC ARTICLE SURVEILLANCE SYSTEM

[75] Inventor: Norman L. Koning, St. Paul, Minn.

[73] Assignee: Minnesota Mining and Manufacturing Company, St. Paul, Minn.

[21] Appl. No.: 954,819

[22] Filed: Oct. 1, 1992

[51] Int. Cl.[5] ..... G08B 13/187

[52] U.S. Cl. ..... 340/551; 340/572

[58] Field of Search ..... 340/551, 572

[56] References Cited

U.S. PATENT DOCUMENTS

| | | | |
|---|---|---|---|
| 3,747,086 | 7/1973 | Peterson | 340/551 |
| 3,765,007 | 10/1973 | Elder | 340/551 |
| 4,074,249 | 2/1978 | Minasy | 340/572 |
| 4,342,904 | 8/1982 | Onsager | 235/493 |
| 4,581,524 | 4/1986 | Hoekman et al. | 235/493 |
| 4,900,386 | 2/1990 | Richter-Jörgensen | 340/572 |
| 4,967,185 | 10/1990 | Montean | 340/572 |

*Primary Examiner*—Glen R. Swann, III

*Attorney, Agent, or Firm*—Gary L. Griswold; Walter N. Kirn; Kari H. Bartingale

[57] ABSTRACT

A marker assembly adapted for use with an electronic article surveillance (EAS) system, and particularly for use with books to be monitored by an EAS system, includes a flat elongated, marker strip of low coercive force, high permeability ferromagnetic material, adhesive layers carried on both the front and rear surfaces of the marker strip and a release liner which extends along the rear surface of the marker strip, around opposed end margins of the marker, and along the front surface thereof, terminating at the approximate midpoint of the marker strip with opposed, graspable tabs carried clear of the adhesive layer on the front surface. Pulling the opposed tabs away from each other removes the wrapper from the front surface, thereby exposing the adhesive carried on that surface and allowing attachment of the front surface to a selected page of the book. Continued pulling of the tabs detaches the wrapper from the rear surface, exposing the adhesive layer carried by that surface for attachment to the adjacent page of the book.

8 Claims, 2 Drawing Sheets

MARKER ASSEMBLY FOR USE WITH AN ELECTRONIC ARTICLE SURVEILLANCE SYSTEM

TECHNICAL FIELD

This invention relates to a marker adapted to be secured to an object for detecting the presence of that object in a zone defined by an associated electronic article surveillance (EAS) system. More particularly, it relates to a ferromagnetic marker that is particularly adapted for placement within a book for selected detection of the book.

BACKGROUND OF THE INVENTION

Theft of books from libraries is an ever increasing problem in terms of expense to the taxpayer and impairment of the information services provided by libraries. In addition, there have been several noted recent instances of theft of relatively rare and valuable books from libraries. With limited resources, libraries cannot afford to lose any books, much less books that are essentially irreplaceable. In the commercial setting, bookstores have an obvious requirement to control shoplifting of expensive inventory, which of necessity is displayed openly and accessibly to both the bona fide patron/customer and the would-be shoplifter.

Electronic article surveillance (EAS) systems for controlling pilferage, especially the unauthorized taking of books from libraries and book stores, are well known. One type of such EAS system employs ferromagnetic markers inserted in the book binding or between two pages of the book. If the article is to be permanently marked to control its passage, such as would be done with a non-circulating reference book, a single-status, non-deactivatable marker will be used. Alternatively, if the article is intended for authorized removal, a deactivatable, dual-status marker will be used. In the latter event, if the marker is not deactivated when the book is properly checked out, the marker will be detected as the book is passed through the interrogation zone of the EAS system. A single status marker would always be so detected. More particularly, the interrogation zone is established by spaced apart detection panels placed across the exits from the library or book store. The panels include field coils for producing an alternating magnetic field across the exits and detector coils for detecting the passage of a marker between the panels.

EAS ferromagnetic markers for use in books typically comprise long, narrow strips that are manually inserted between two pages of the book, close to the binding of the book. Each side of the strip is coated with an adhesive to secure the marker to the book pages. When properly placed in a book, the markers are difficult to visually detect, difficult to remove, and do not detract from the ability of the reader to use and enjoy the book.

The key to proper placement of an EAS marker within a book is proper packaging of the marker such that the marker can be quickly and readily inserted deeply between two pages, as close as possible to the book's binding, for relatively permanent, adhesive retention in such position. As will be appreciated, depending on the stiffness of the book's binding, it can be difficult to locate the EAS marker in the desired position deep between two pages and keep it in that position while exposing the adhesive on the opposing sides of the marker to the two facing pages of the book.

An EAS marker assembly suitable for such book marking has two adhesive release liner strips; one covering the adhesive on each side of the marker. In use, one of the two covering strips is removed, exposing the adhesive on one side of the marker. The other cover strip includes opposed ends that extend beyond the ends of the narrow, elongated marker. The ends can be grasped in opposite hands of the person placing the strip in a book. When properly placed, the adhesive on the exposed side of the marker adheres to a page of the book, close to the book's binding. The second covering strip is then removed, and the adhesive on the second exposed side of the marker adheres to a second page of the book directly opposite the first page.

While use of the marker described above has proven beneficial and has gained wide acceptance, the two-step process of removing the covering strip can prove cumbersome. For instance, removal of the strips generates static electricity, and the strips, once removed from the marker, tend to be attracted to the user's hands and are difficult to dispose of. The disposal nuisance created by the static clinging of the strips to the user's hands is essentially doubled by the use of two separate strips to cover each marker.

SUMMARY OF THE INVENTION

The EAS marker assembly, in accordance with the present invention, is adapted for use with an EAS system having an interrogation zone for detecting the presence of a premarked article within the zone. The marker assembly includes a single wrapper, or release liner, that provides for a one-step process for inserting the marker in the book, while still providing for suitable protective covering of adhesives on the marker, per se, prior to secural of the marker to an article.

The marker assembly hereof includes a marker having a detectable element with a front surface, an opposed rear surface, and opposed end margins. Pressure sensitive adhesive layers are carried by both the front and rear surfaces for attaching the marker to articles to be protected. Where such an article is a book, the marker is desirably attached to facing pages close to the binding of the book. A continuous, removable wrapper, i.e., release liner, covers all of both adhesive layers. The wrapper is removably adhered to the adhesive layer on the rear side of the marker, extends around the end margins, and is removably adhered to the front side of the marker, terminating with opposed end tabs extending away from the marker at the approximate midpoint of the front side. The end tabs of the wrapper are thus adapted for grasping. By first pulling the tabs away from each other, one detaches the wrapper from the front side of the marker, enabling that side to be attached to a selected page of the book. Continued pulling of the tabs after the front side of the marker is attached to a selected page removes the wrapper from the rear side of the marker, exposing the adhesive thereon for attachment to an adjacent, opposed page of the book.

The marker of the present invention, having such a continuous wrapper, thus facilitates a one-step installation process, and provides distinct advantages over currently known EAS marker packages.

DETAILED DESCRIPTION OF THE INVENTION

Figure 1:
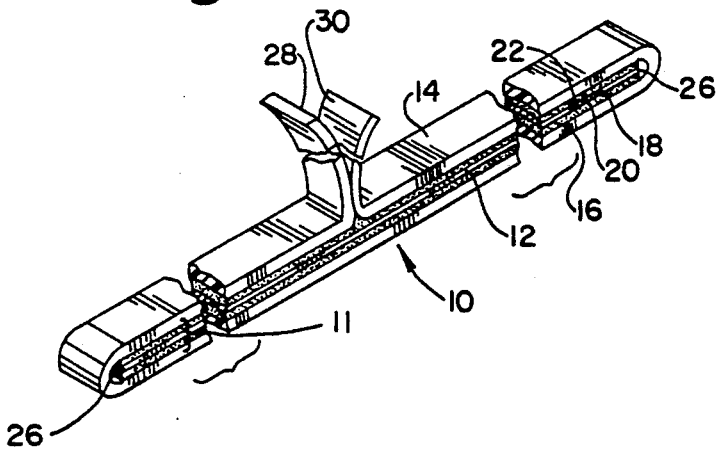
FIG. 1 is a perspective view of one embodiment of the marker assembly in accordance with the present invention.

Referring to FIG. 1 of the drawing, a preferred EAS marker assembly 10 in accordance with the present invention broadly includes a marker 11 comprising a narrow, elongated ferromagnetic marker strip 12, and adhesive layers 16 and 20 on either side of the strip 12. The assembly 10 further includes one-piece wrapper 14 removably carried along the opposed sides of respective adhesive layers. The first adhesive layer 16 is thus applied to the rear surface 18 of the strip 12 and the second adhesive layer 20 is applied to the front surface 22 of the strip 12. The wrapper 14 substantially covers the adhesive layers 16 and 20 prior to placement of the marker 11 in an article to be monitored by an EAS system. The wrapper 14 is wrapped around the opposed end margins 26 of the member 11 and removably covers the second adhesive layer 20. Wrapper 14 terminates in hand graspable tabs 28 and 30 that extend free of the second adhesive layer 20.

Figure 2:
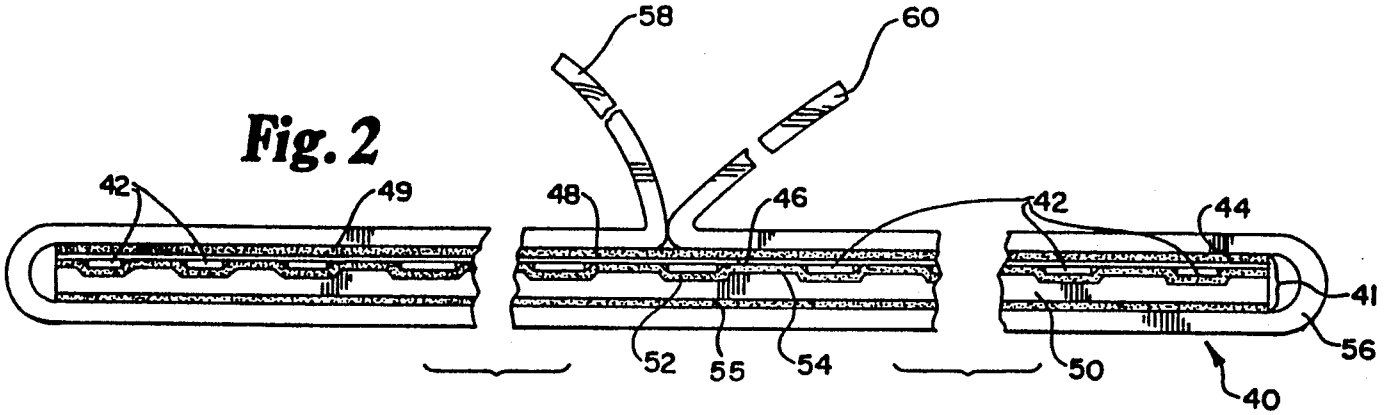
FIG. 2 is a side view of another embodiment of the present invention.

As further shown in FIG. 2, the ferromagnetic marker assembly 40 may also be made to include a dual status EAS marker 41 having a plurality of high coercive force elements 42 positioned adjacent to a narrow, elongated, low coercive force, high permeability marker strip 44. The front surface 46 of the elongated strip 44 carries an adhesive layer 48, the front surface 49 of which in turn comprises the front surface of the marker 41. In this embodiment, an elongated paper element 50 is attached by a second adhesive layer 52 to the opposed surface 54 of the elongated strip 44. The plurality of elements 42 are interposed between the paper element 50 and elongated strip 44, and are in that manner fixedly held in place.

As in the embodiment of FIG. 1, the marker assembly 40 also includes a one-piece wrapper, or release liner 56, which covers the adhesive layers 48 and 55 and terminates with tabs 58 and 60.

The markers 11 and 41, once in place in a book, are used with a sensor system (not shown) which typically includes a drive oscillator, amplifier, and field coils for generating an alternating magnetic field within an interrogation zone and receiving coils and associated circuitry for processing signals produced in that zone. The high permeability, low coercive force strips 12 and 44 have the ability to rapidly switch magnetic orientation when passed through the alternating magnetic field, and to produce a predetermined characteristic response which may be detected by the receiving coils.

In the embodiment shown in FIG. 2, the switching action of the elongated strip 44 is controlled by the magnetization of the high coercive force elements 42. When the elements 42 are magnetized, the ability of the elongated strip 44 to switch back and forth within the alternating magnetic field of the interrogation zone is inhibited and the characteristic response is altered. When the elements 42 are selectively demagnetized, the switching action of the elongated strip 44 can take place as described.

In both embodiments, the wrappers 14 and 56 comprise a release liner carried along the rear and front surfaces of the markers 11 and 41. The wrappers 14 and 56 are preferably constructed of relatively thin, polymeric material. The polymeric material is pliable, such that it can conform to the shape of the marker and can be wrapped around the end margins of the marker. The wrappers 14 and 56 are specifically designed as a single piece of material that can cover substantially all of the markers 11 and 41. Accordingly, the wrappers have a length that is approximately twice the length of marker plus the lengths of the two tabs.

The marker assemblies 10 and 40 are preferably made from roll stock of the respective components of the marker package, each respective roll having a width corresponding to the length of that component in the ultimate assembly. Thus, for example, the elongated strip materials 12 and 44, respectively, are provided from a roll of high-permeability, low-coercive force material, such as permalloy, having a width 6.5 inches (16.5 cm) in an embodiment where the ultimate length of that component in the marker is 6.5 (16.5 cm) inches. A paper layer, such as layer 50 in the embodiment shown in FIG. 2, would have a similar length, as would that of the respective adhesive layers 48 and 52, and would, therefore, be provided by rolls of comparable width. These respective layers, together with narrow strips of the respective high-coercive force materials 42 in the case where a marker such as that shown in FIG. 2 is being assembled, would then be brought together and appropriately positioned to provide a laminate containing the components of the respective markers per se. Such a laminate is then positioned over and centered with a continuous film of wrapper material, having a width at least twice the length of the ultimate marker, together with an additional length sufficient to provide the hand graspable tabs of the ultimate marker assembly, i.e., approximately 20 inches wide. The laminate is pressed onto the wrapper material, and each opposing edge of the web of wrapper material is then brought around the edges of the laminate and stuck to the opposed, exposed adhesive surface leaving the two edge pieces of the wrapper protruding upward mid-distant from the respective edges/end margins. The resultant laminate making up the marker assemblies is then intermittently passed through a shearing device and repeatedly sheared to form marker assemblies having the desired width.

The wrapper material is selected from known release liner materials such as silicone treated paper, polypropylene, polyethylene, etc., while the first and second adhesive layers comprise pressure sensitive adhesive materials that adhere more aggressively to the exposed surfaces of the marker than to the wrapper material. As such, the wrapper can be removed from the marker, leaving substantially all of the adhesive layers affixed to the marker. Such an assembly may desirably comprise 4 mil thick silicone coated polyethylene over 2 mil thick pressure sensitive adhesive layers.

Figure 3:
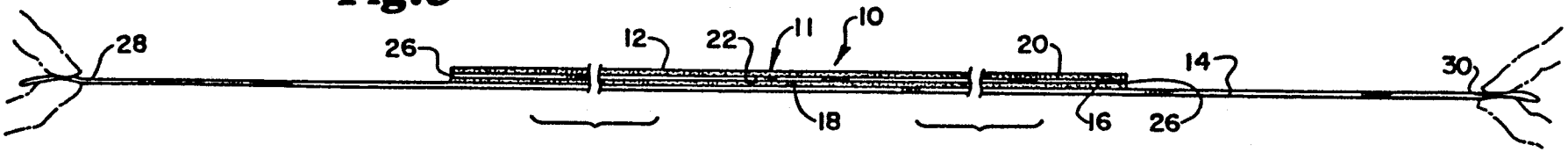
FIG. 3 is a side view of the marker assembly of FIG. 1, with the marker wrapper pulled free of the front side of the marker and with a user's fingers depicted in phantom lines.

The marker assembly of the present invention may be used to insert a marker in an article, such as a book, as follows:

A book B in which the marker 11 is to be placed is opened to any pair of opposed pages. The marker 11 is then placed loosely near the binding between the two selected pages, and the tabs 28 and 30 are grasped and pulled in opposite directions, as shown in FIG. 3. The second adhesive layer 20 carried by the front surface 22 of the marker 11 is accordingly exposed, with the tabs 28 and 30 extending beyond marker end margins and beyond the ends of the book binding for ease of handling. With the book B opened as far as possible, the marker 11 is positioned as deeply as possible between the book pages, close to the book binding. Finger pressure is applied to adhere the front surface 22 of marker 11 to its facing page, thereby binding the marker 11 to the page in contact with the adhesive layer 20.

Figure 4:
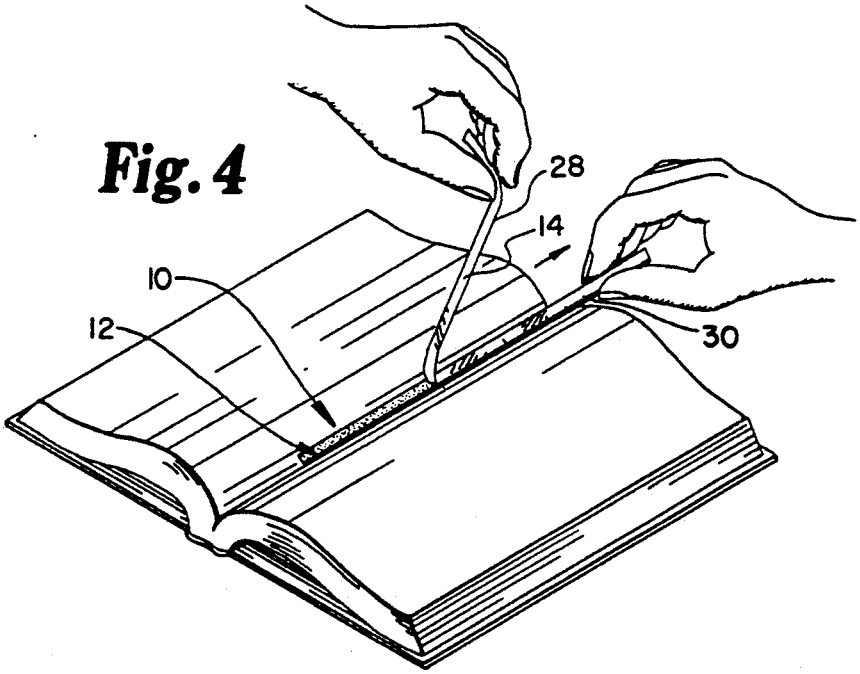
FIG. 4 is a perspective view of a marker assembly positioned on one page of a book close to the book's binding, and prior to removal of the wrapper from the backside of the marker.

As further shown in FIG. 4, the user next pulls either tab 28 or tab 30 in the opposite direction from which such tab was first pulled, and thereby exposes the adhesive layer 16 carried by the rear surface 18 of marker 11, while fully detaching the wrapper 14 from the marker 11. Simply closing the book B at this point brings the second adhesive layer 16 into contact with its facing page, permanently installing the marker 11 within the book. The marker installation process is thus significantly simplified and converted into a one-handed operation, as an operator need only grasp one end tab while holding the book open to remove the wrapper, prior to then closing the book. And only one-half as many discrete pieces of wrapper material are left behind, with an attendant decrease in the number of pieces clinging to apparel, due to electrostatic forces and equally decreasing clean-up efforts.

The marker is difficult to visually detect, and does not interfere with normal use of the book. Prior to checkout of the book from a library or book store, a dual status marker, such as marker 41 of FIG. 2, is activated so as to respond to the alternating magnetic field of an EAS system interrogation zone. Such marker 41 is deactivated during the checkout process by magnetizing the high coercive force elements 42, allowing the book to pass through the interrogation zone without detection of the marker 41 and sounding of an alarm.

The marker assembly of the present assembly of the present invention has been described hereinabove only in the context of an elongated ferromagnetic marker. The present invention also recognizes that such a marker assembly may also include non-elongated ferromagnetic markers such as the "QUADRATAG" EAS markers manufactured by Minnesota Mining and Manufacturing Company. Similarly, non-magnetic EAS markers, such as those based on microwave and radio frequency detectable devices, may also be assembled to facilitate similar ease of installation.

Also, the wrapper, as described hereinabove, may be formed of any variety of treated materials having reduced adhesive properties when placed against a pressure-sensitive adhesive and the end tab portions of such materials may be formed to enhance the graspability of those tab portions. Thus, for example, the tabs may be crimped, notched, or otherwise modified.

While not being a primary aspect of the present invention, it should also be recognized that the components of the ferromagnetic markers described herein may be made of a wide variety of known materials. Thus, for example, the low-coercive force, high-permeability elongated strips 12 and 44 of the respective figures may be formed of permalloy, amorphous ferromagnetic alloys, and other similar low-coercive force materials. Likewise, the magnetizable elements 42, as shown in FIG. 2, while preferably made of a magnetizable material such as vicalloy, may also be formed of blue steel, arnochrome and other ferromagnetic alloys having a coercive force in the range of 50 to several hundred oersteds.

What is claimed is:

1. A marker assembly adapted for use with an electronic article surveillance system having an interrogation zone for detecting the presence of a premarked article within the zone, comprising a marker adapted to be secured to the article to enable detection of the article within the interrogation zone, the marker including a detectable element having a front surface, an opposed rear surface, and opposed end margins and adhesive means operably carried by the front and rear surfaces for attachment of the marker to the article, wherein said marker assembly further comprises wrapper means removably attached to the adhesive means, and having oppositely directed portions extending continuously over the rear surface of the marker, around respective end margins and along the front surface so as to cover substantially all of the adhesive on both surfaces, terminating with opposed graspable end tabs carried clear of the adhesive means on said front surface, whereby the pulling of the opposed end tabs away from each other will remove the wrapper means from said front surface of the marker thereby exposing the adhesive means carried by that surface and allowing attachment of that surface to the article, and continued pulling of the end tabs will remove the wrapper means from the rear surface, further exposing the adhesive means carried by the rear surface to enable additional attachment.

2. A marker assembly according to claim 1, wherein said marker comprises an elongated, narrow ferromagnetic strip adapted for placement between a pair of book pages adjacent said book's binding.

3. A marker assembly according to claim 2, said strip presenting a marker length, said marker length being less than the length of said book's binding, and said wrapper means comprising a narrow, elongated wrapper element presenting a wrapper element length longer than said book's binding length when said opposed wrapper ends are pulled away from each other.

4. A marker assembly according to claim 2, wherein said marker further comprises at least one remanantly magnetizable element, which, when magnetized, changes a characteristic response produced by said ferromagnetic strip, thereby preventing its detection in said zone.

5. A marker assembly according to claim 1, wherein the graspable end tabs of the wrapper means are located generally mid-distance between said end margins.

6. A marker assembly according to claim 1, wherein the wrapper means comprises a thin, polymeric film.

7. A marker assembly adapted to be secured to an article to enable detection of that article in an interrogation zone of an electronic article surveillance system, said marker assembly comprising a marker element detectable in said zone, and having a front surface, an opposed rear surface, and opposed end margins, adhesive means carried by said front and rear surfaces, and a release liner removably adhered to said adhesive means, having oppositely directed portions extending continuously over the adhesive means on one surface, around respective end margins, and along the opposite surface, terminating with opposed end tabs carried clear of the adhesive means on the opposite surface, which tabs may be grasped to successively pull the liner first from the adhesive layer on the opposite surface and then from the adhesive layer on said one surface.

8. A method of attaching a marker to an article whose presence is desirably detected in an interrogation zone of an electronic article surveillance system, said method comprising providing a marker assembly including a marker element detectable in said zone and having a front surface, an opposed rear surface, and opposed end margins, adhesive means carried by said front and rear surfaces and release liner means, oppositely directed portions of which extend continuously over the adhesive means on one surface, around respective end portions and along the opposite surface, terminating with opposed end tabs carried clear of the adhesive means on the opposite surface, pulling said end tabs away from each other and away from said opposite surface to expose the adhesive means, pressing the exposed adhesive means onto a surface of said article, further pulling said tabs away from said one surface to expose the adhesive thereon, and pressing the exposed adhesive onto another surface of said article.

* * * * *